US010119702B2

(12) United States Patent
Fendler et al.

(10) Patent No.: US 10,119,702 B2
(45) Date of Patent: Nov. 6, 2018

(54) CANDLE LAMP

(71) Applicants: Michael Fendler, Pittsfield, ME (US); Stephen Fendler, White Plains, NY (US)

(72) Inventors: Michael Fendler, Pittsfield, ME (US); Stephen Fendler, White Plains, NY (US)

(73) Assignee: CM Almy & Son, Inc., Armonk, NY (US)

( * ) Notice: Subject to any disclaimer, the term of this patent is extended or adjusted under 35 U.S.C. 154(b) by 454 days.

(21) Appl. No.: 14/837,134

(22) Filed: Aug. 27, 2015

(65) Prior Publication Data

US 2017/0059155 A1 Mar. 2, 2017

(51) Int. Cl.
*F23D 3/02* (2006.01)
*F23D 3/18* (2006.01)
*F23D 3/08* (2006.01)

(52) U.S. Cl.
CPC ..... *F23D 3/18* (2013.01); *F23D 3/02* (2013.01); *F23D 3/08* (2013.01)

(58) Field of Classification Search
CPC ..... F23D 3/18; F23D 3/02; F23D 3/08
USPC ..... 431/320
See application file for complete search history.

(56) References Cited

U.S. PATENT DOCUMENTS 2,503,496 A * 4/1950 Kwasniewski ..... F21V 37/00 431/125
3,097,514 A * 7/1963 Stone ..... F23D 3/16 222/187
4,693,681 A 9/1987 Comstock
5,193,994 A * 3/1993 Schirneker ..... F21S 13/12 431/289
5,338,187 A 8/1994 Elharar
5,840,246 A * 11/1998 Hammons ..... A01M 1/2088 239/54
6,217,314 B1 4/2001 Kiesinger et al.
6,312,251 B1 * 11/2001 Schmorleitz ..... F23D 3/24 126/45
6,328,935 B1 * 12/2001 Buccellato ..... A61L 9/03 422/123
6,347,879 B1 2/2002 Prado
6,511,314 B2 1/2003 Johnson
6,638,060 B1 10/2003 Rivard et al.
6,918,681 B2 7/2005 Brizzie
7,073,920 B2 7/2006 Konkle, Jr. et al.
7,232,550 B1 * 6/2007 Rodgers ..... A61L 9/03 422/125
7,568,913 B2 * 8/2009 Decker ..... A61L 9/037 431/298
8,724,975 B2 5/2014 Browder et al.
(Continued)

FOREIGN PATENT DOCUMENTS

KR 20130131066 A * 12/2013

OTHER PUBLICATIONS

English Translation of KR 20130131066 A.*

*Primary Examiner* — Alfred Basichas
(74) *Attorney, Agent, or Firm* — Anthony D. Pellegrini

(57) ABSTRACT

A candle lamp suitably adapted to burn liquid fuel to support a light-emitting flame, with the candle lamp having an exterior shell that has the appearance of a traditional wax or tallow candle, and a fragrance matrix which provides a fragrance when exposed to the heat of a flame when the candle lamp is in use.

7 Claims, 12 Drawing Sheets

(56) References Cited

U.S. PATENT DOCUMENTS

| | | | | |
|---|---|---|---|---|
| 9,428,713 | B2 * | 8/2016 | Tyson | C11C 5/002 |
| 2006/0024629 | A1 | 2/2006 | Rivard | |
| 2006/0039685 | A1 * | 2/2006 | Berrido | A61L 9/02 392/392 |
| 2007/0264603 | A1 | 11/2007 | Ruff | |
| 2010/0270391 | A1 * | 10/2010 | Allison | A01M 1/2088 239/44 |
| 2011/0134628 | A1 * | 6/2011 | Pestl | F21V 33/004 362/96 |
| 2014/0087318 | A1 * | 3/2014 | Chen | F23D 3/18 431/320 |

* cited by examiner

CANDLE LAMP

BACKGROUND OF THE INVENTION

1. Technical Field

The present invention relates generally to fuel burning illumination devices and, more particularly, to candle lamps.

2. Description of Prior Art

A candle lamp is an illumination device that burns liquid fuel drawn through a wick to produce a light-emitting flame. Similar to lanterns, candle lamps additionally often seek to provide the appearance of a traditional wax or tallow candle. They have the advantage over traditional candles, though, of not being consumed during use, so that they always have a "new" appearance, i.e., they retain their aesthetics during and after use (a traditional candle that is consumed during use decreases in size and may have an altered shape and/or color, rendering it aesthetically less desirable after even short term use). However, candle lamps known in the art tend not to also provide a fragrance when being operated, as do traditional wax or tallow candles. Moreover, candle lamps known in the art are typically relatively large and placed onto flat surfaces during use, such as a tabletop, and are not compatible with traditional candle stick holders. The device claimed herein seeks to address these deficiencies.

It is therefore an objective of the present invention to provide a candle lamp that burns liquid fuel to produce a light-emitting flame.

It is a further objective of the present invention to provide a candle lamp that has the appearance of a traditional wax or tallow candle.

It is yet a further objective of the present invention to provide a candle lamp that gives off a fragrance when in use.

It is yet a further objective of the present invention to provide a candle lamp that may be used with a traditional candlestick holder.

It is yet a further objective of the present invention to provide a candle lamp that has a refillable liquid fuel reservoir.

It is yet a further objective of the present invention to provide a candle lamp that utilizes a replaceable fragrance matrix.

It is yet a further objective of the present invention to provide a candle lamp that utilizes a sculpturally decorative form that is distinct from a traditional candle, Other objectives of the present invention will be readily apparent from the description that follows.

SUMMARY OF THE INVENTION

In one aspect, the invention is directed to a fluid burning candle lamp comprising an exterior shell, an upper wall, a lower wall, an interior compartment, a wick, a wick aperture, and a fragrance matrix. The exterior shell may be configured to have the appearance of a traditional wax or tallow candle, while at the same time providing or containing the reservoir for the liquid fuel. The exterior shell may be sized to be placed onto a flat surface during use, or alternately, designed to be placed onto a traditional candlestick holder through the use of an adapter suitably configured to be inserted at one end into the base of the exterior shell and at another end into the candlestick holder. The upper wall retains the wick in place while providing a visual barrier to the interior compartment of the exterior shell, thus shielding the liquid fuel reservoir from view. It also may support the fragrance matrix. The upper wall may be secured to the exterior shell by use of threads formed into the perimeter of the upper wall and corresponding to threads formed on the inside of the exterior shell. Alternatively, the upper wall may be secured to the exterior shell by use of a bayonet fitting. The upper wall provides a wick aperture to allow the wick to access the liquid fuel. The wick may be encased in a wick sleeve which is configured to hold the wick and to retain the wick in its proper orientation within the candle lamp, keeping one end of the wick in contact with the liquid fuel and the other end of the wick above the upper wall where it may maintain a flame. The wick sleeve passes through the wick aperture and engages with the upper wall to achieve this functionality. The fragrance matrix is a material suitably configured to retain one or more vaporizable fragrance additives. It is placed proximate to the flame so that the heat of the flame causes the fragrance matrix to give off a fragrance.

The candle device of the present invention may also comprise one or more of the following features or characteristics: the exterior shell may be substantially cylindrical; the exterior shell may be made up of three or more substantially planar surfaces; the exterior shell may be made up of one or more curved surfaces and one or more substantially planar surfaces; the exterior shell may be tapered; the exterior shell may be translucent; the exterior shell may be colored to appear to be a beeswax candle; the exterior shell may comprise a crown extending above the top of the wick; the exterior shell may comprise a foot extending below the interior compartment containing the liquid fuel; liquid fuel may be placed directly into the interior compartment of the exterior shell; liquid fuel may be placed into a separate fuel container located within the interior compartment of the exterior shell; the upper wall may be fixedly attached to the exterior shell; the upper wall may be removably attached to the exterior shell; the lower wall may be removably attached to the exterior shell; the fragrance matrix may be placed onto the top surface of the upper wall; the fragrance matrix may be attached to the underside of the upper wall; and the fragrance matrix may be contained within a ventilated fragrance chamber located within the interior compartment of the exterior shell.

Other features and advantages of the invention are described below.

DETAILED DESCRIPTION OF THE INVENTION

Figure 2:
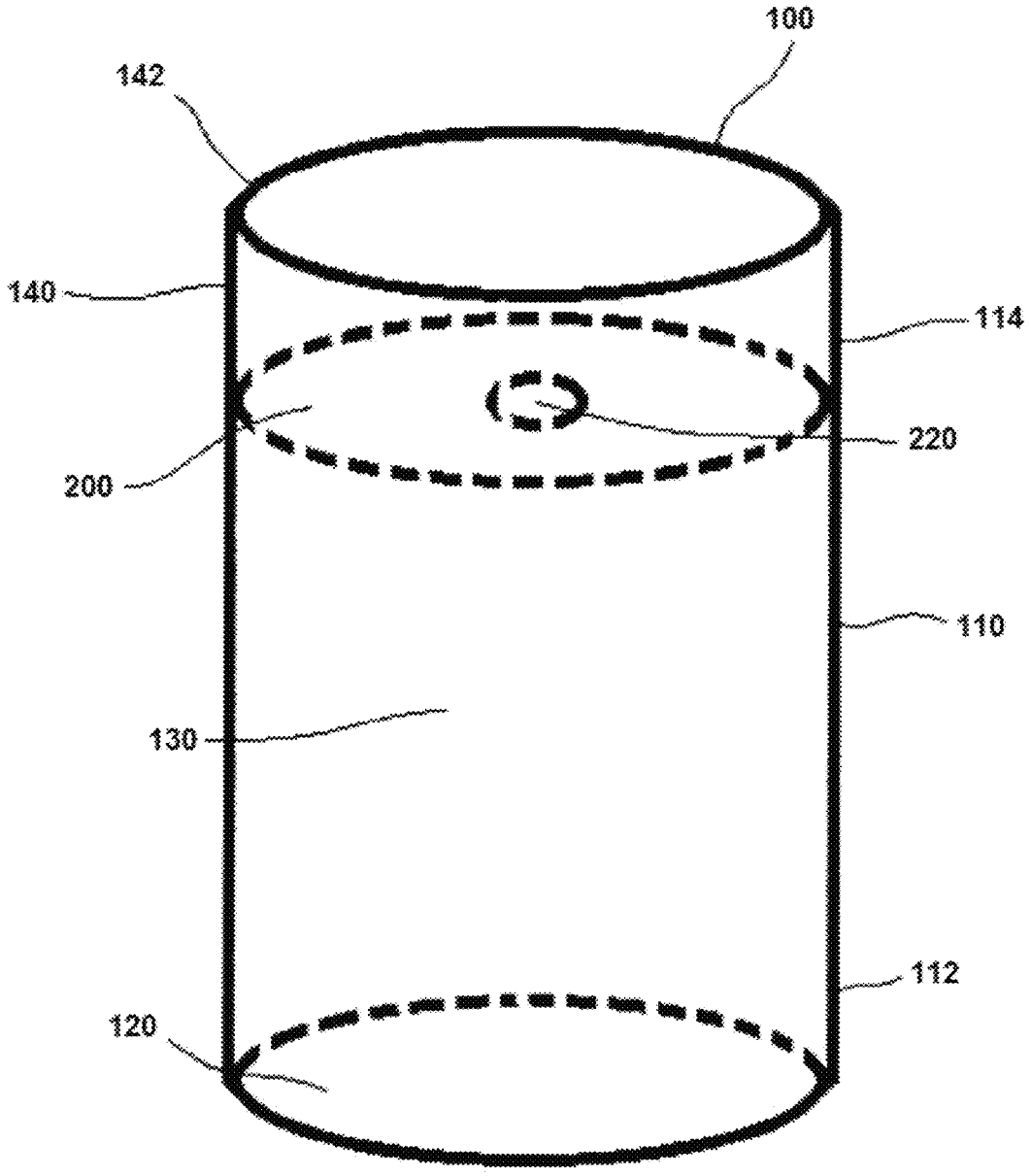
FIG. 2 is a perspective side view of the candle lamp shown in FIG. 1, with various components of the exterior shell identified and the upper wall shown in ghost line.
Figure 3A:
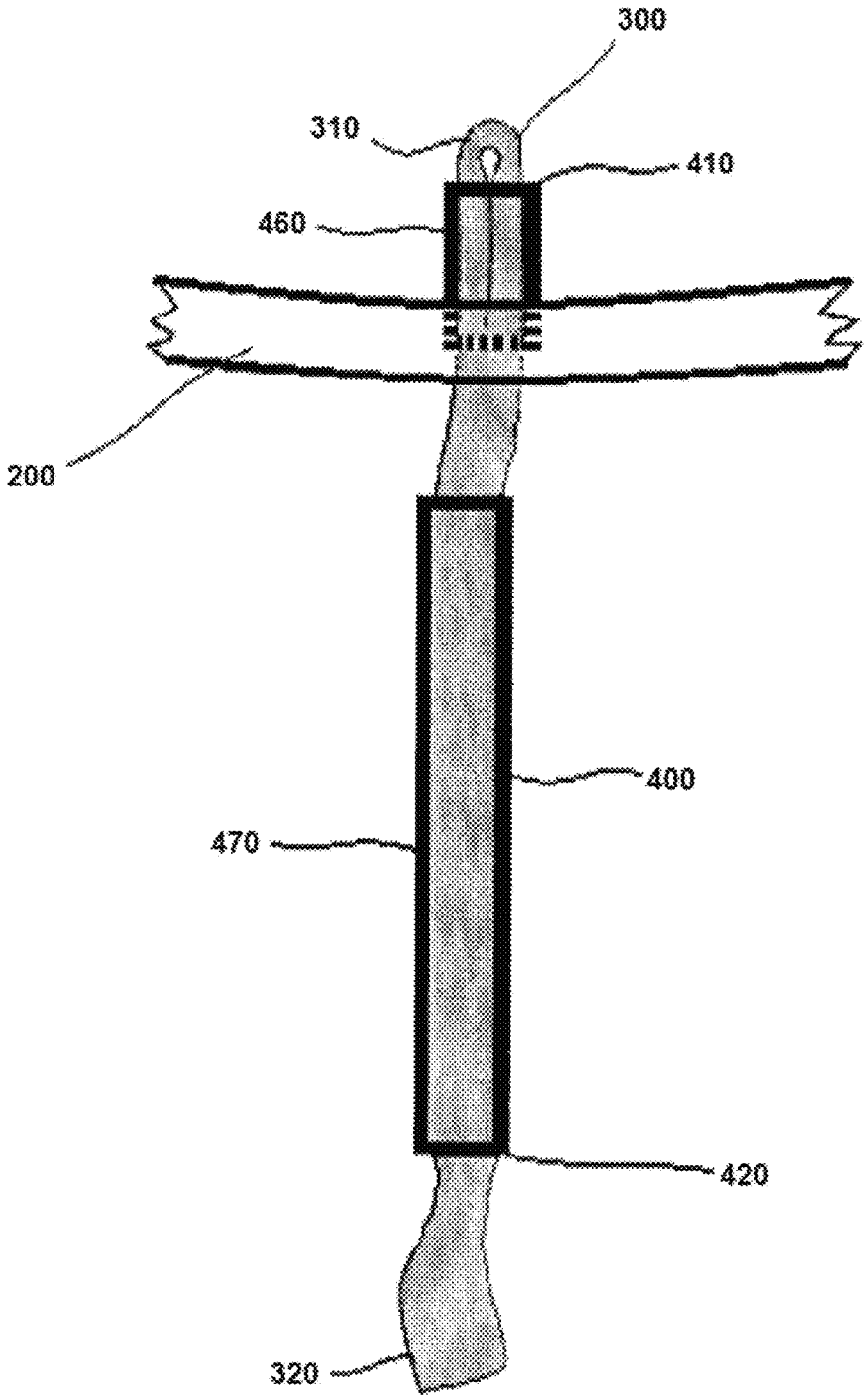
FIG. 3A is a plan side view of a wick contained within a two-part embodiment of a wick sleeve.
Figure 3B:
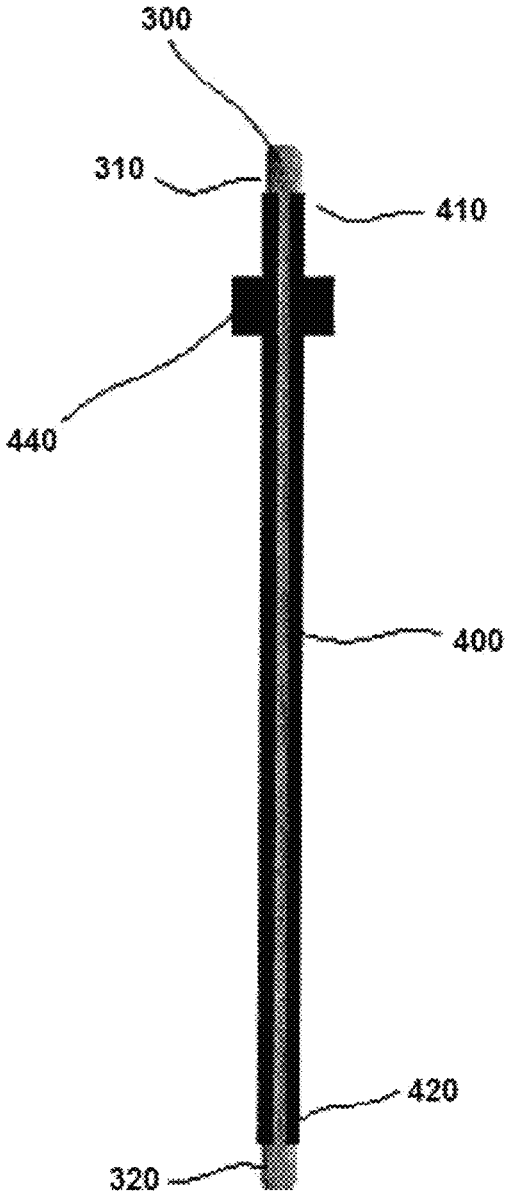
FIG. 3B is a plan side view of a wick contained within a one-part embodiment of a wick sleeve.
Figure 4:
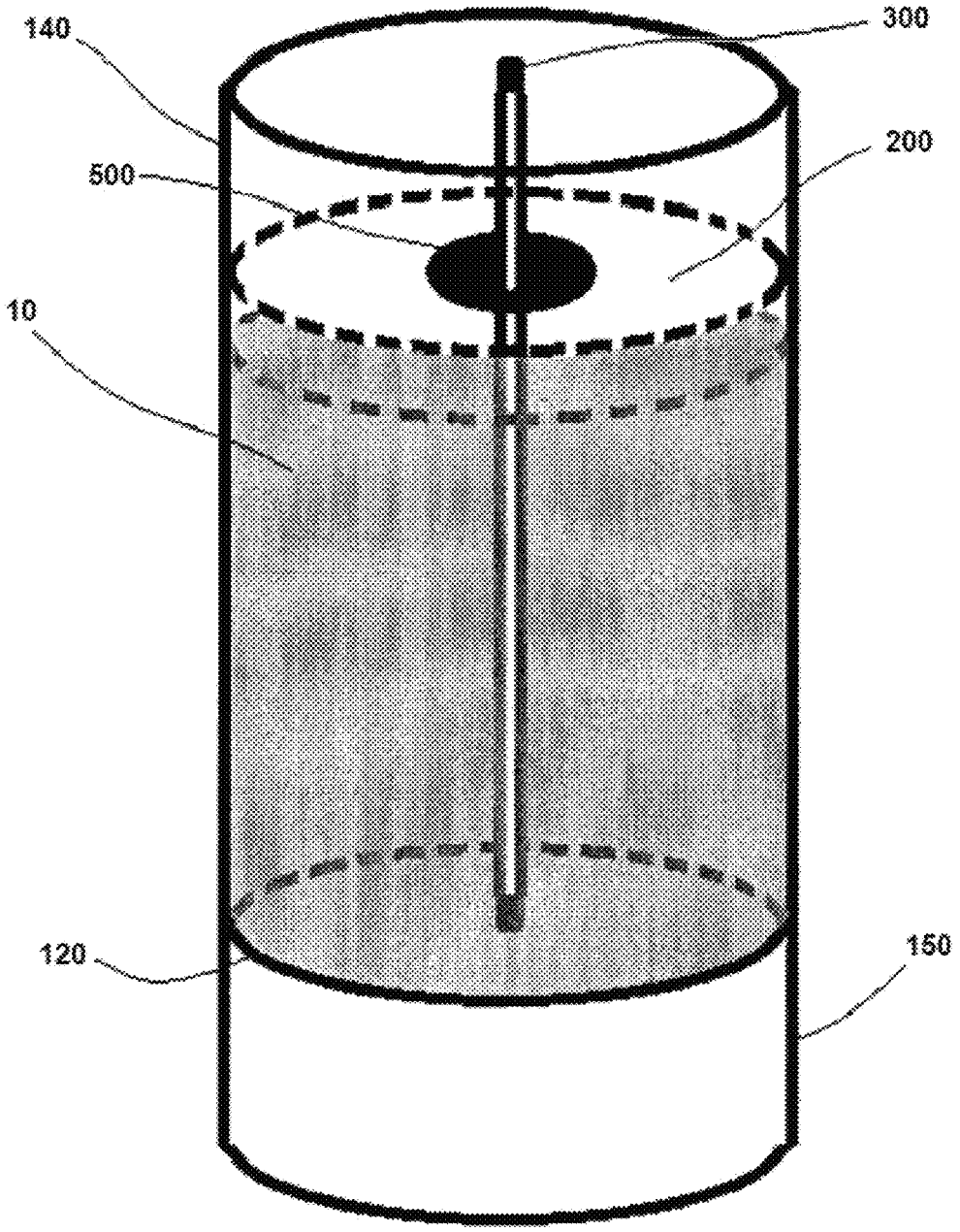
FIG. 4 is a perspective side view of the candle lamp shown in FIG. 2, with the wick and wick sleeve of FIG. 3A included along with liquid fuel.
Figure 5:
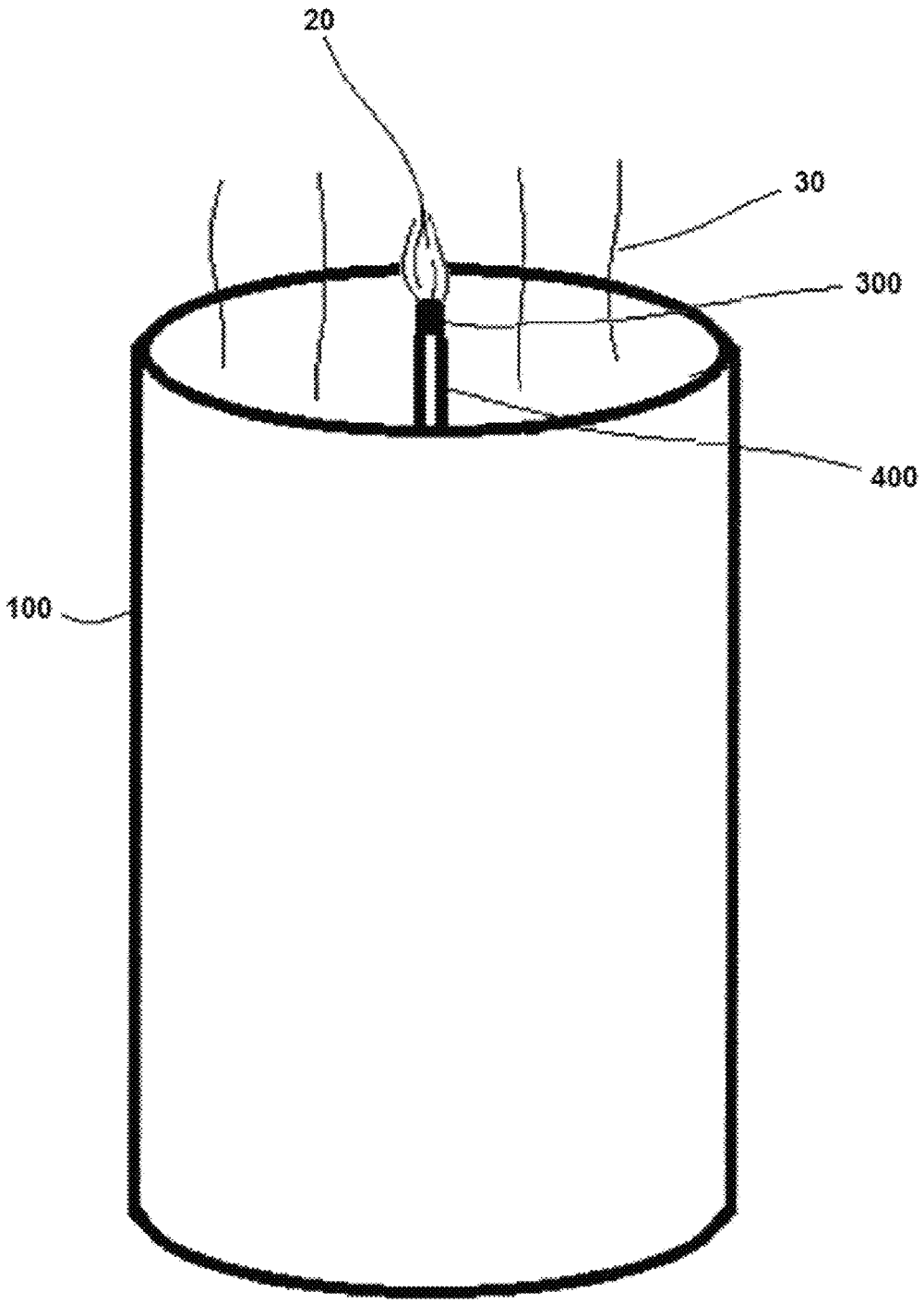
FIG. 5 is a perspective side view of one embodiment the candle lamp of the present invention.

One aspect of the invention is drawn to a fluid burning candle lamp 1. See FIG. 5. The candle lamp 1 comprises, at a minimum, an exterior shell 100, an upper wall 200, a lower wall 120, an interior compartment 130, a wick 300, and a wick aperture 220. The upper wall 200 fits into an upper portion 114 of the side wall 110 of the exterior shell 100, and has formed in its center the wick aperture 220. See FIG. 2. The wick 300 is inserted into and through the wick aperture 220, leaving a portion of the wick 300 above the upper wall 200 and a portion of the wick 300 below the upper wall 200 and in contact with liquid fuel 10. See FIGS. 3A and 3B. There may be a fragrance matrix 500 located proximate to the wick 300 such that it may be exposed to the heat of a flame 20 borne at the upper end 310 of the wick 300, thereby giving off a fragrance 30. See FIG. 4.

The exterior shell 100 has a side wall 110, an upper wall 200, a substantially flat lower wall 120, and an interior enclosed compartment 130. See FIG. 2. The lower wall 120 is located adjacent to and in connection with a lower portion 112 of the side wall 110. The upper wall 200 is located above the lower wall 120, adjacent to and in connection with an upper portion 114 of the side wall 110. The side wall 110 of the exterior shell 100, the lower wall 120 of the exterior shell 100, and the upper wall 200 define the interior compartment 130 of the exterior shell 100. Liquid fuel 10 may be contained within the interior compartment 130.

Figure 1:
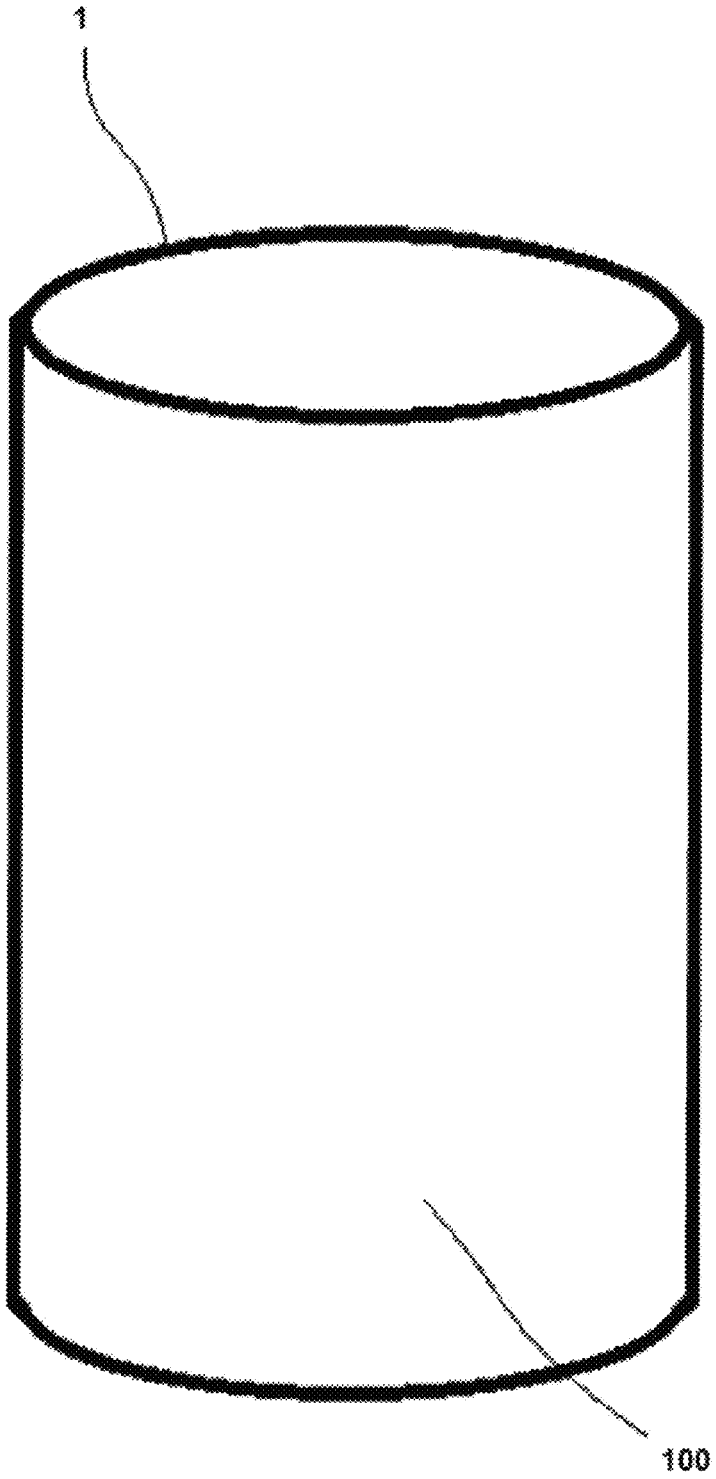
FIG. 1 is a perspective side view of the exterior shell of the candle lamp of the present invention.
Figure 6:
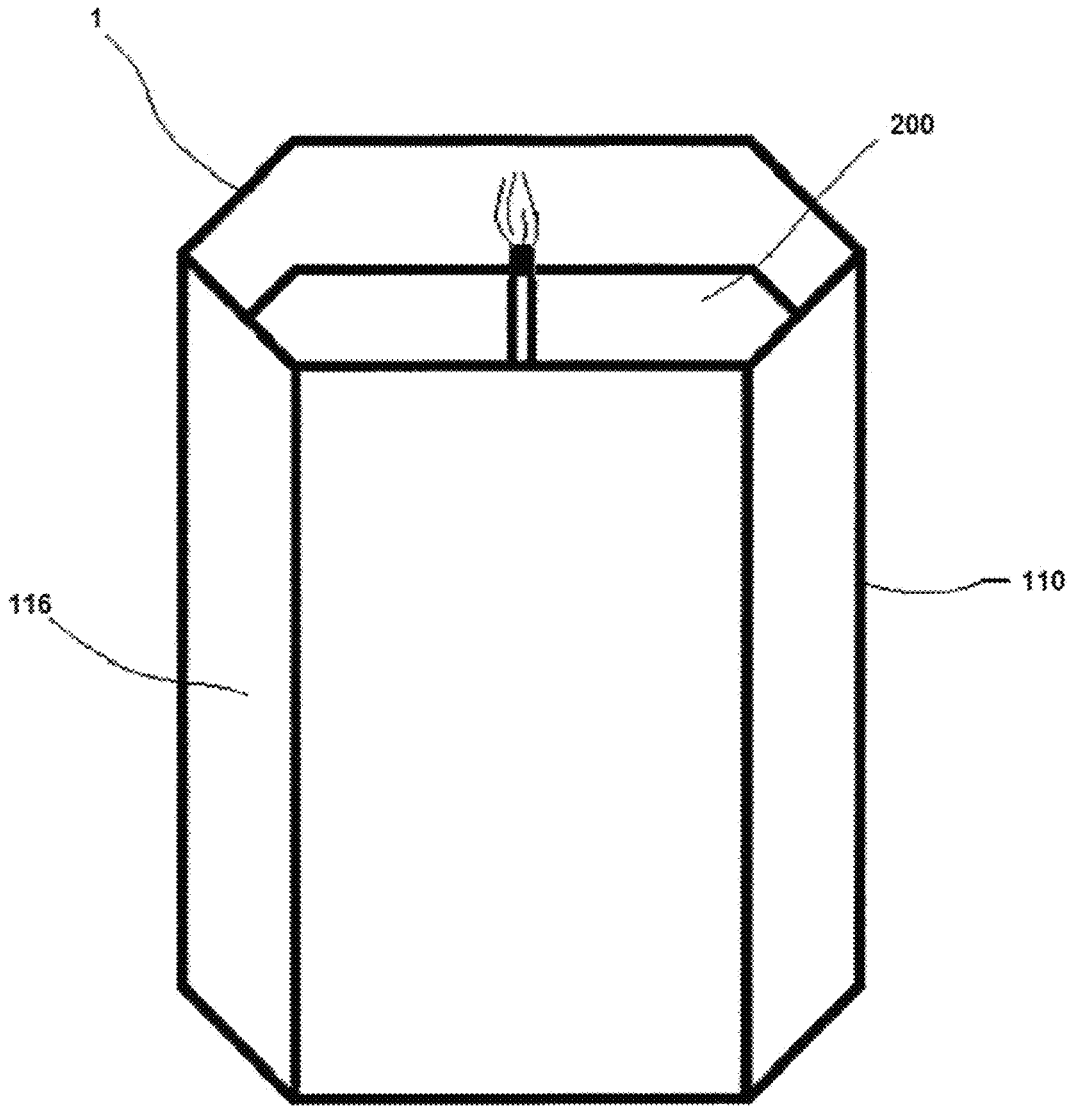
FIG. 6 is a perspective side view of another embodiment the candle lamp of the present invention.

The exterior shell 100 of the candle lamp 1 may have any suitable shape. In the preferred embodiment the exterior shell 100 has a substantially cylindrical shape, with a curved circumferential side wall 110. See FIG. 1. In such configurations, the upper and lower walls 200,120 of the exterior shell 100 are substantially circular. Other configurations of the exterior shell 100 are also contemplated. For example, the side wall 110 of the exterior shell 100 may be comprised of three or more substantially planar surfaces 116, resulting in the side wall 110 having a polygonal cross-section. In such embodiments, the lower wall 120 of the exterior shell 100 will have substantially the same shape as the cross-section of the side wall 110 of the exterior shell 100, as will the upper wall 200. Where the side wall 110 of the exterior shell 100 has three substantially planar surfaces 116, the side wall 110 will have a triangular cross-section and the lower wall 120 of the exterior shell 100 and the upper wall 200 will likewise be triangular. Where the side wall 110 of the exterior shell 100 has four substantially planar surfaces 116, the side wall 110 will have a rectangular (or square) cross-section and the lower wall 120 of the exterior shell 100 and the upper wall 200 will likewise be rectangular (or square). Where the side wall 110 of the exterior shell 100 has six substantially planar surfaces 116, the side wall 110 will have a hexagonal cross-section and the lower wall 120 of the exterior shell 100 and the upper wall 200 will likewise be hexagonal. See FIG. 6. In yet other embodiments, the side wall 110 of the exterior shell 100 may be comprised of a combination of curved and planar surfaces 116. For example, the front and back sides may be planar, with curved left and right sides. The exterior shell 100 may have a curved circumferential side wall 110 and a substantially oval or elliptical cross section. The upper portion 114 of the side wall 110 may have a shape or dimension different from the lower portion 112 of the side wall 110, for example, to provide a tapered effect, whereby the upper and lower walls 200,120 have the same shape but are differently sized. The exterior shell 100 may be substantially spherical. The exterior shell 100 may have a highly stylized, irregular shape. These and other shapes for the exterior shell 100 are all contemplated by the invention.

The exterior shell 100 of the candle lamp 1 may be constructed of any suitable material. In the preferred embodiment it is constructed of a nylon material. It may also be constructed of different polymers, metal, metal alloys, glass, or other materials. The material used should be heat resistant such that it will not become damaged by the heat given off by a flame 20. In the preferred embodiment the exterior shell 100 is substantially translucent. It may also be configured and colored to appear to be a beeswax candle. Alternatively, the outer surface of the exterior shell can be cast in different colors of nylon, it can be dyed different colors, and it can be decorated with graphics using ink jet printing and/or silk screen techniques. Other aesthetic effects are also contemplated.

In some embodiments, the side wall 110 of the exterior shell 100 extends upward above the upper wall 200, forming a crown 140. See FIG. 4. The crown 140 should be of sufficient height such that when the wick 300 is placed into the wick aperture 220 the upper end 310 of the wick 300 is positioned at or slightly above a top edge 142 of the crown 140 (it is important to keep the flame 20 at some distance from the exterior shell 100 to prevent discoloration or scorching).

In other embodiments, the side wall 110 of the exterior shell 100 extends downward below the lower wall 120, forming a foot 150. See FIG. 4. The foot 150 has a bottom edge 152. In such embodiments, there may be a bottom panel 160 located adjacent to and in connection with the foot 150 of the exterior shell 100 proximate to the bottom edge 152 of the foot 150.

Figure 9:
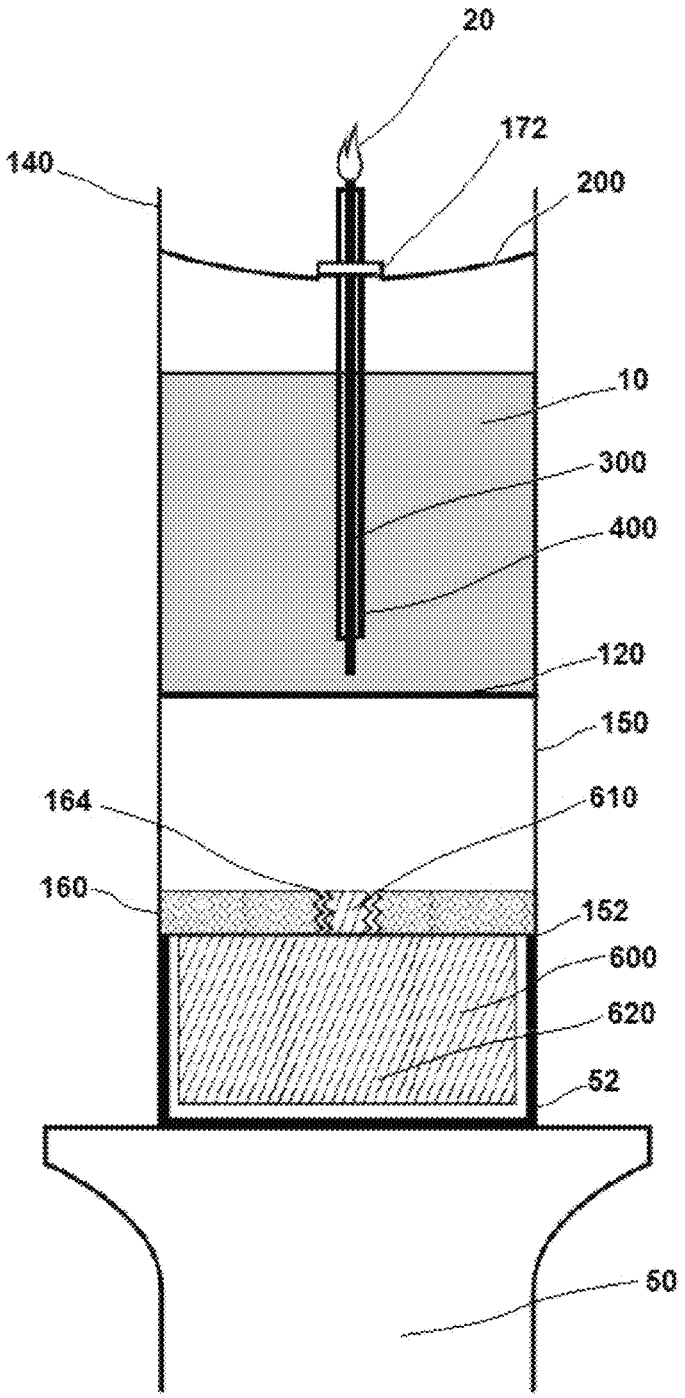
FIG. 9 is a plan side view showing an embodiment of the candle lamp configured for use with a candle stick holder. For clarity, internal features are shown as though the exterior shell
Figure 10A:
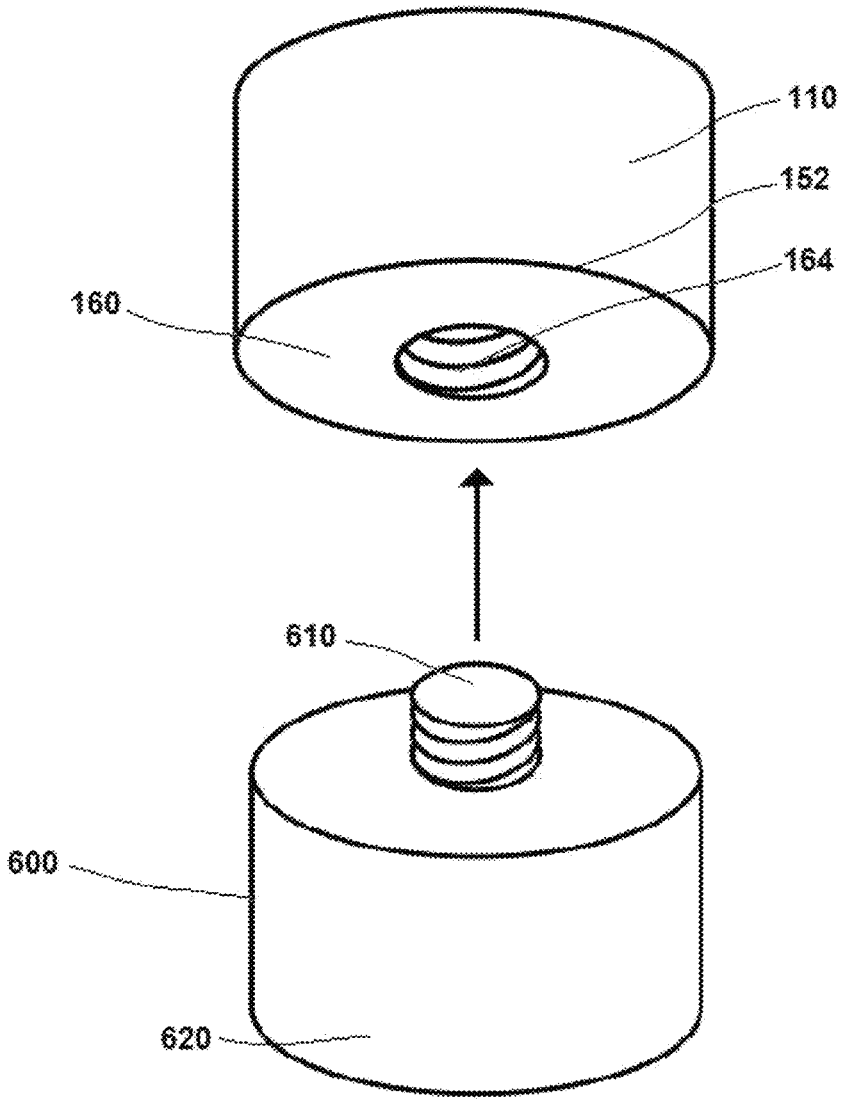
FIG. 10A is a perspective bottom view of the candle lamp shown in FIG. 9, showing a threaded configuration of the adapter and the bottom panel of the exterior shell.
Figure 10B:
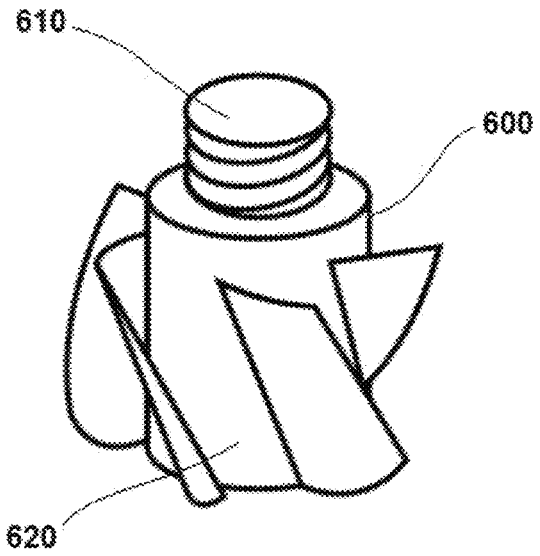
FIG. 10B is a perspective bottom view of an alternative embodiment of the adapter, having flexible flanges.

In yet other embodiments having a foot 150 and a bottom panel 160, the bottom panel 160 may have a central aperture 164. The aperture 164 is designed to accommodate an adapter 600. See FIG. 9. The adapter 600 has a connection member 610 which is suitably configured to engage with the aperture 164 of the bottom panel 160, so that the adapter 600 can be removably attached to the candle lamp 1. See FIG. 10A. The adapter 600 also has a lower portion 620 located opposite its connection member 610, suitably configured to be inserted into a receiving socket 52 of a standard candle stick holder 50. Thus, using the adapter 600, the candle lamp 1 may be mounted onto a candle stick holder 50. See FIG. 9. The connection member 610 of the adapter 600 may be threaded; if so, the aperture 164 in the bottom panel 160 is also threaded, and the threaded connection member 610 of the adapter 600 is capable of being threaded into the threaded aperture 164 of the bottom panel 160. See FIG. 10A. Alternatively, the connection member 610 of the adapter 600 may be friction fit into the aperture 164 of the bottom panel 160. In order to facilitate fitting the adapter 600 into a candle stick holder 50, the lower portion 620 of the adapter 600 should be made of a flexible material, such as rubber, or fashioned in such a way as to allow a more rigid material, such as nylon, to flex and fit into various candle holder sizes and shapes. See FIG. 10B.

Figure 7A:
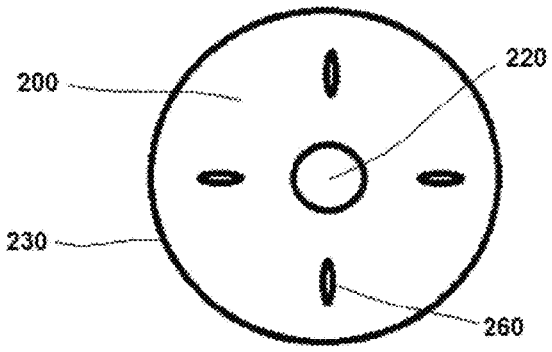
FIG. 7A is a plan top view of one embodiment of the upper wall.
Figure 7B:
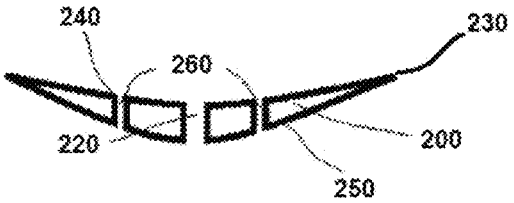
FIG. 7B is a plan side view of the embodiment of the upper wall shown in FIG. 7A.
Figure 7C:
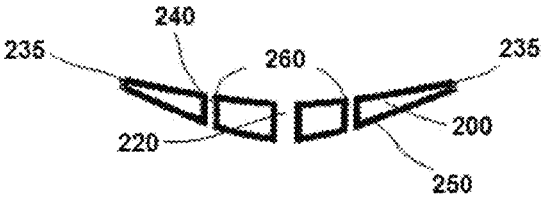
FIG. 7C is a plan side view of an embodiment of the upper wall shown in FIG. 7A having perimeter threads for removable attachment to the exterior shell.
Figure 7D:
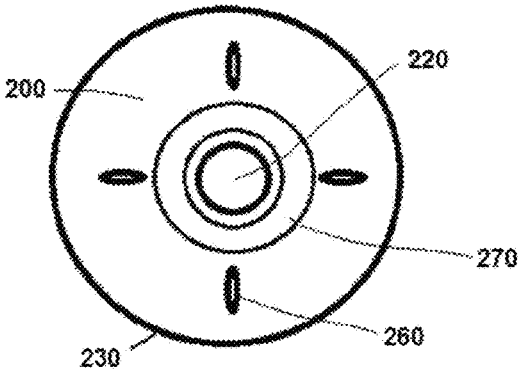
FIG. 7D is a plan top view of another embodiment of the upper wall.
Figure 7E:
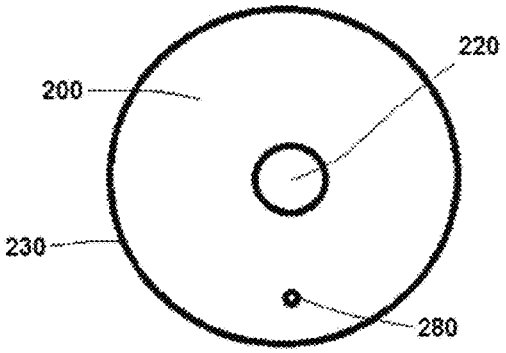
FIG. 7E is a plan top view of yet another embodiment of the upper wall.

The upper wall 200 may have any suitable configuration. In the preferred embodiment, it is slightly concave, with its central portion lower than its perimeter 230. See FIG. 7B. In other embodiments it may be substantially planar. The wick aperture 220 is formed into the central portion of the upper wall 200. The wick aperture 220 is formed into and through the upper wall 200 and is configured to accommodate a wick sleeve 400. The wick sleeve 400 contains the wick 300 and passes into and through the wick aperture 220 and is held in place therein. The upper wall 200 may have formed into and through it a small pinhole vent 280 to equalize pressure in the interior compartment as it empties of fuel. See FIG. 7E. The upper wall 200 may be constructed of any suitable material. In one embodiment it may be constructed of the same material as the side wall 110 of the exterior shell 100. In another embodiment it may be constructed of flame resistant glass, such as Pyrex™. In yet another embodiment it may be constructed of a metal or ceramic material.

The upper wall 200 may be fixedly attached to the side wall 110 of the exterior shell 100. In the most preferred embodiments, the upper wall 200 is removably attached to the side wall 110 of the exterior shell 100. This may be accomplished by friction fitting the upper wall 200 onto the side wall 110. Alternatively, there may be internal threads formed in the side wall 110 and threads 235 formed into the perimeter 230 of the upper wall 200, thus allowing the upper wall 200 to be threaded into the exterior shell 100. See FIG. 7C. There may also be a circumferential groove formed into the interior surface of the side wall 110, with the upper wall 200 configured to snap into and out of the groove. Other means for removably attaching the upper wall 200 to the side wall 110 of the exterior shell 100 are also contemplated.

In an alternative embodiment the lower wall 120 is removably attached to the side wall 110 of the exterior shell 100 to provide access to interior compartment 130 from the underside of the candle lamp 1. This may be accomplished by friction fitting the lower wall 120 onto the side wall 110. Alternatively, there may be internal threads formed in the side wall 110 and threads formed into the perimeter of the lower wall 120, thus allowing the lower wall 120 to be threaded into the exterior shell 100. There may also be a circumferential groove formed into the interior surface of the side wall 110, with the lower wall 120 configured to snap into and out of the groove. Other means for removably attaching the lower wall 120 to the side wall 110 of the exterior shell 100 are also contemplated.

The wick 300 may be of any suitable length. It has an upper end 310 and a lower end 320, with the lower end 320 suitable for being placed into liquid fuel 10, such that the wick 300 is capable of drawing liquid fuel 10 up from its lower end 320 to its upper end 310. The upper end 310 of the wick 300 is suitable for maintaining a flame 20. The wick 300 may be constructed of any suitable material. In the preferred embodiment the wick 300 is constructed of fiberglass.

The wick sleeve 400 is configured to accommodate the wick 300. It should have a substantially cylindrical shape with a hollow interior, an opened first end 410, and an opened second end 420. See FIGS. 3A and 3B. The wick sleeve 400 should be configured to snugly accommodate the wick 300 within its hollow interior, with the upper end 310 of the wick 300 proximate to and extending above the first end 410 of the wick sleeve 400 and the lower end 320 of the wick 300 proximate to and extending below the second end 420 of the wick sleeve 400. In some embodiments the lower end 320 of the wick 300 may not extend below the second end 420 of the wick sleeve 400. The wick sleeve 400 may be constructed of any suitable material. In the preferred embodiment it is constructed of flame resistant glass, such as Pyrex™. In the most preferred embodiment, the first end 410 of the wick sleeve 400 is diamond cut but left unsmoothed and unpolished to create a rough, but not sharp, surface. This provides for a greater surface area for the liquid fuel 10 from the wick 300 to spread onto, thereby aiding ignition and sustenance of the flame 20. As such, the wick height may be set to less than 1/16 of an inch above the first end 410 of the wick sleeve 400. If the first end 410 of the wick sleeve 400 is smooth, not enough liquid fuel 10 can be sustained thereon and the wick 300 must be raised to at least approximately 3/16 of an inch above the first end 410 of the wick sleeve 400 in order for there to be enough liquid fuel 10 present (between that found on the wick 300 and that found on the first end 410 of the wick sleeve 400) to sustain a flame 20. However, the longer the exposed portion of the wick 300, the easier it is for a user to attempt to lower the height of the wick 300 by trimming it. This can lead to a suboptimal height of the flame 20, causing excessive use of fuel and inefficient burning, or damage to the wick which impairs candle operation. A shorter portion of exposed wick 300, which is made possible by the first end 410 of the wick sleeve 400 being diamond cut to a rough surface, makes it difficult for a user to attempt to trim the height of the wick 300, thereby preserving optimal height of the flame 20.

The wick sleeve 400 is configured to be placed into and through the wick aperture 220 of the upper wall 200. See FIG. 4. The wick sleeve 400 is held in place within the upper wall 200 by any suitable means. In one embodiment the wick sleeve 400 is held within the wick aperture 220 by frictional forces. These may be enhanced by the use of a gasket. In another embodiment the wick sleeve 400 has an external protuberance 440 located between the first and second ends 410,420 of the wick sleeve 400. See FIG. 3B. The protuberance 440 has an outside diameter greater than the internal diameter of the wick aperture 220. This allows the second end 420 of the wick sleeve 400 to pass into and through the wick aperture 220, but the protuberance 440 does not pass through the wick aperture 220 but instead rests against the top surface 240 of the upper wall 200. The protuberance 440 may be an annular ring. It may be a single projection, or a plurality of projections arrayed about the wick sleeve 400. It may be a gasket that is slipped onto the wick sleeve 400. Other configurations of the protuberance 440 are also contemplated.

In the most preferred embodiment the wick sleeve 400 is configured to have two discontinuous portions, an upper portion 460 and a lower portion 470. See FIG. 3A. The upper portion 460 of the wick sleeve 400 contains its first end 410 and the lower portion 470 of the wick sleeve 400 contains its second end 420. The upper portion 460 of the wick sleeve 400 is inserted into the wick aperture 220 of the upper wall 200 and fixedly attached thereto. It should be constructed of flame resistant glass, such as Pyrex™, or from another flame proof material such as metal or ceramic. The wick 300 is held within the upper portion 460 of the wick sleeve 400 by frictional forces. The lower portion 470 of the wick sleeve 400 is friction fitted to the portion of the wick 300 that suspends below the upper wall 200. The lower portion 470 of the wick sleeve 400 may be constructed of any material of substantially cylindrical shape that serves to weight down the wick 300, thereby keeping it from floating in the liquid fuel 10. The lower portion 470 of the wick sleeve 400 may be constructed of braided cotton, semi rigid plastic material, glass, metal, or the like. It need not be flame resistant.

The fragrance matrix 500 is any suitable substance configured to retain one or more vaporizable fragrance additives. When exposed to heat generated by a flame 20, the fragrance matrix 500 releases fragrance 30. In one embodiment the fragrance matrix 500 is a flexible material impregnated with fragrant oils. This may take the form of a porous plastic material. In another embodiment the fragrance matrix 500 may be contained in a heat resistant ceramic shell that can be molded into decorative forms. The fragrance matrix 500 may be placed onto the top surface 240 of the upper wall 200, close to the wick 300. In yet another embodiment, the fragrance matrix 500 may be a flowable substance, such as wax. Alternatively, the flowable substance may be a solution of fragrance oil and a diluent, such as alcohol or glycerin. In this embodiment, the upper wall 200 has an annular recessed channel 270 formed around the wick aperture 220, and the fragrance matrix 500 is flowed into the channel 270. See FIG. 7D. A removable liner may be used with the annular channel 270 to facilitate cleanup. The liner may be plastic, or it may be cast with metal filaments that conduct more heat from the upper wall 200 to its outer perimeter 230. The liner may be open on the top, or it may be sealed with a thin membrane that permit fragrant gaseous vapors to escape but holds the flowable substance in. In yet another embodiment the fragrance matrix 500 is attached to the underside 250 of the upper wall 200. In such an embodiment the upper wall 200 may comprise one or more additional apertures 260 formed into and through the upper wall 200 to allow fragrance 30 to rise out of the interior compartment 130 of the exterior shell 100 of the candle lamp 1.

Figure 8:
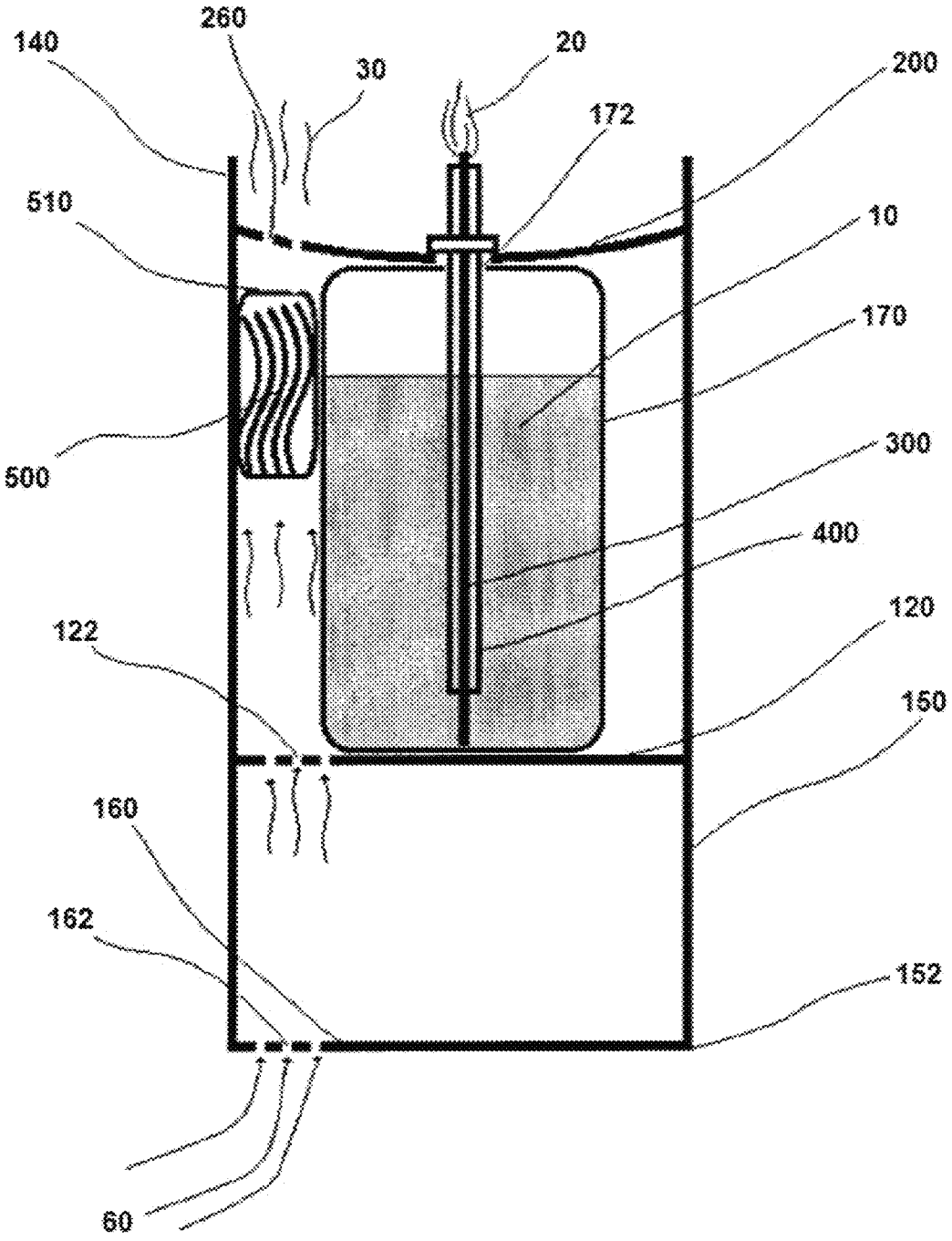
FIG. 8 is a plan side view showing an embodiment of the candle lamp configured for use with a fragrance container. For clarity, internal features are shown as though the exterior shell were transparent.

In yet another embodiment, the candle lamp comprises a separate fuel container 170 suitable for containing liquid fuel 10. See FIG. 8. The fuel container 170 is placed within the interior compartment 130 of the exterior shell 100 below the upper wall 200. It has a top aperture 172 which aligns with the wick aperture 220 of the upper wall 200, such that the lower end 320 of the wick 300 may be inserted into the fuel container 170 through its top aperture 172. In such an embodiment, the fuel container 170 may substantially fill the entire volume of the interior compartment 130 of the exterior shell 100.

Alternatively, the fuel container 170 does not fill the entire volume of the interior compartment 130 of the exterior shell 100. In such an embodiment, a fragrance chamber 510 may be placed into the interior compartment 130 of the exterior shell 100 outside of the fuel container 170. The fragrance chamber 510 has an interior and a plurality of ventilation apertures, and is suitable for containing the fragrance matrix 500 within its interior. The fragrance matrix 500 may be felt blotting paper or any other suitable material impregnated with fragrant oils. To facilitate the escape of fragrance 30, the lower wall 120 of the exterior shell 100 may comprise one or more apertures 122 formed into and through it, and the upper wall 200 may comprise one of more apertures 260 formed into and through it. See FIG. 7A. Air 60 may then enter the apertures 122 formed into the lower wall 120, rise through the interior compartment 130 of the exterior shell 100, and pass through the ventilation apertures of the fragrance chamber 510; fragrance 30 is then carried out of the interior compartment 130 of the exterior shell 100 by air 60 rising through the apertures 260 formed in the upper wall 200. This embodiment may also comprise an exterior shell 100 having a foot 150, as described above, thus forming a void under the lower wall 120 to more easily facilitate the movement of air 60. If a bottom panel 160 is used, there should be one or more apertures 162 formed into the bottom panel 160 to permit entry of air 60 into the void. If no bottom panel 160 is used, there should be one or more apertures formed into foot 150, or alternatively the bottom edge 152 of the foot 150 may be irregular to allow for air 60 to pass under the bottom edge 152 when the candle lamp 1 is placed on a flat surface.

The invention is not limited to what is described in the foregoing embodiments. For example, although a candle lamp 1 which has the appearance of a traditional wax or tallow candle is described in detail, the principles described herein may be used in the construction and manufacture of a candle lamp 1 having any type of appearance, including a transparent exterior shell 100 to provide a visual access to all of the interior components.

Other embodiments not specifically set forth herein are also within the scope of the following claims, whereby modifications and variations can be made to the disclosed embodiments of the present invention without departing from the subject or spirit of the invention as defined in the following claims.

The invention claimed is:

1. A fluid burning candle lamp comprising an exterior shell, said exterior shell having a side wall and an interior enclosed compartment suitably configured to contain a liquid fuel;

an upper wall, said upper wall being adjacent to and in connection with an upper portion of the side wall of the exterior shell;

a lower wall, said lower wall being adjacent to and in connection with a lower portion of the side wall of the exterior shell, with the side wall of the exterior shell, the upper wall of the exterior shell, and the lower wall of the exterior shell defining the interior compartment of the exterior shell;

a wick, said wick being an elongate cord-like member having an upper end and a lower end, with the lower end suitable for being placed into said liquid fuel, said wick capable of drawing said liquid fuel up from its lower end to its upper end, with said upper end suitable for maintaining a flame; and a wick aperture, said wick aperture formed into and through the upper wall and configured to accommodate the wick, such that the wick passes into and through said wick aperture and is held in place therein, with the upper end of the wick located above the upper wall and the lower end of the wick located below the upper wall within the interior compartment of the exterior shell;

wherein the upper wall is removably attached to the upper portion of the side wall of the exterior shell such that the upper wall can be repeatedly attached to and detached from the upper portion of the side wall of the exterior shell without the use of tools, independent fasteners, or adhesives and without damage to the upper wall or to the upper portion of the side wall of the exterior shell;

whereby the upper wall has a secured state and an unsecured state, with the secured state of the upper wall being achieved when the upper wall is attached to the upper portion of the side wall of the exterior shell in a manner that prevents the upper wall from separating from the upper portion of the side wall of the exterior shell, and with the unsecured state of the upper wall being achieved when the upper wall is not prevented from separating from the upper portion of the side wall of the exterior shell; and the lower wall is removably attached to the lower portion of the side wall of the exterior shell such that the lower wall can be repeatedly attached to and detached from the lower portion of the side wall of the exterior shell without the use of tools, independent fasteners, or adhesives and without damage to the lower wall or to the lower portion of the side wall of the exterior shell;

whereby the lower wall has a secured state and an unsecured state, with the secured state of the lower wall being achieved when the lower wall is attached to the lower portion of the side wall of the exterior shell in a manner that prevents the lower wall from separating from the lower portion of the side wall of the exterior shell, and with the unsecured state of the lower wall being achieved when the lower wall is not prevented from separating from the lower portion of the side wall of the exterior shell.

2. A fluid burning candle lamp comprising an exterior shell, said exterior shell having a side wall and an interior enclosed compartment suitably configured to contain a liquid fuel;

an upper wall, said upper wall being adjacent to and in connection with an upper portion of the side wall of the exterior shell;

a lower wall, said lower wall being adjacent to and in connection with a lower portion of the side wall of the exterior shell, with the side wall of the exterior shell, the upper wall of the exterior shell, and the lower wall of the exterior shell defining the interior compartment of the exterior shell, with the side wall of the exterior shell extending downward below the lower wall, forming a foot, said foot having a bottom edge;

a wick said wick being an elongate cord-like member having an upper end and a lower end, with the lower end suitable for being placed into said liquid fuel, said wick capable of drawing said liquid fuel up from its lower end to its upper end, with said upper end suitable for maintaining a flame;

a wick aperture, said wick aperture formed into and through the upper wall and configured to accommodate the wick, such that the wick passes into and through said wick aperture and is held in place therein, with the upper end of the wick located above the upper wall and the lower end of the wick located below the upper wall within the interior compartment of the exterior shell;

a bottom panel, said bottom panel being adjacent to and in connection with the foot of the exterior shell proximate to the bottom edge of the foot of the exterior shell, and an adapter, said adapter having a lower portion suitably configured to be inserted into a candle stick holder, said adapter having a connection member located opposite its lower portion suitably configured to engage with an aperture of the bottom panel, being removably attached thereto, whereby the candle lamp is mounted onto a candle stick holder through use of the adapter;

wherein the upper wall is removably attached to the upper portion of the side wall of the exterior shell such that the upper wall can be repeatedly attached to and detached from the upper portion of the side wall of the exterior shell without the use of tools, independent fasteners, or adhesives and without damage to the upper wall or to the upper portion of the side wall of the exterior shell;

whereby the upper wall has a secured state and an unsecured state, with the secured state being achieved when the upper wall is attached to the upper portion of the side wall of the exterior shell in a manner that prevents the upper wall from separating from the upper portion of the side wall of the exterior shell, and with the unsecured state being achieved when the upper wall is not prevented from separating from the upper portion of the side wall of the exterior shell.

3. The candle lamp of claim 2 wherein the aperture of the bottom panel is threaded and the connection member of the adapter is threaded, whereby the threaded connection member of the adapter is capable of being threaded into the threaded aperture of the bottom panel.

4. The candle lamp of claim 2 wherein the lower portion of the adapter is made of a material which is temporarily deformable under loading but is not permanently deformable under loading.

5. A fluid burning candle lamp comprising an exterior shell, said exterior shell having a side wall and an interior enclosed compartment suitably configured to contain a liquid fuel;

an upper wall, said upper wall being adjacent to and in connection with an upper portion of the side wall of the exterior shell, with the upper portion of the side wall of the exterior shell having a set of inner circumferential threads, and the upper wall having a set of circumferential perimeter threads, wherein the circumferential perimeter threads of the upper wall are configured to engage with the inner circumferential threads the upper portion of the side wall of the exterior shell;

a lower wall, said lower wall being adjacent to and in connection with a lower portion of the side wall of the exterior shell, with the side wall of the exterior shell, the upper wall of the exterior shell, and the lower wall of the exterior shell defining the interior compartment of the exterior shell;

a wick, said wick being an elongate cord-like member having an upper end and a lower end, with the lower end suitable for being placed into said liquid fuel, said wick capable of drawing said liquid fuel up from its lower end to its upper end, with said upper end suitable for maintaining a flame; and a wick aperture, said wick aperture formed into and through the upper wall and configured to accommodate the wick, such that the wick passes into and through said wick aperture and is held in place therein, with the upper end of the wick located above the upper wall and the lower end of the wick located below the upper wall within the interior compartment of the exterior shell;

wherein the upper wall is removably attached to the upper portion of the side wall of the exterior shell such that the upper wall can be repeatedly attached to and detached from the upper portion of the side wall of the exterior shell without the use of tools, independent fasteners, or adhesives and without damage to the upper wall or to the upper portion of the side wall of the exterior shell;

whereby the upper wall has a secured state and an unsecured state, with the secured state being achieved when the upper wall is attached to the upper portion of the side wall of the exterior shell in a manner that prevents the upper wall from separating from the upper portion of the side wall of the exterior shell, and with the unsecured state being achieved when the upper wall is not prevented from separating from the upper portion of the side wall of the exterior shell, and the secured state of the upper wall is achieved by threading the upper wall into the upper portion of the side wall of the exterior shell by engaging the circumferential perimeter threads of the upper wall with the inner circumferential threads of the upper portion of the side wall of the exterior shell, and the unsecured state of the upper wall is achieved by unthreading the upper wall from the upper portion of the side wall of the exterior shell.

6. A fluid burning candle lamp comprising an exterior shell, said exterior shell having a side wall and an interior enclosed compartment suitably configured to contain a liquid fuel;

an upper wall, said upper wall being adjacent to and in connection with an upper portion of the side wall of the exterior shell, with the upper portion of the side wall of the exterior shell having an inner circumferential groove, wherein the upper wall is configured to engage with the inner circumferential groove of the upper portion of the side wall of the exterior shell;

a lower wall, said lower wall being adjacent to and in connection with a lower portion of the side wall of the exterior shell, with the side wall of the exterior shell, the upper wall of the exterior shell, and the lower wall of the exterior shell defining the interior compartment of the exterior shell;

a wick, said wick being an elongate cord-like member having an upper end and a lower end, with the lower end suitable for being placed into said liquid fuel, said wick capable of drawing said liquid fuel up from its lower end to its upper end, with said upper end suitable for maintaining a flame; and a wick aperture, said wick aperture formed into and through the upper wall and configured to accommodate the wick, such that the wick passes into and through said wick aperture and is held in place therein, with the upper end of the wick located above the upper wall and the lower end of the wick located below the upper wall within the interior compartment of the exterior shell;

wherein the upper wall is removably attached to the upper portion of the side wall of the exterior shell such that the upper wall can be repeatedly attached to and detached from the upper portion of the side wall of the exterior shell without the use of tools, independent fasteners, or adhesives and without damage to the upper wall or to the upper portion of the side wall of the exterior shell;

whereby the upper wall has a secured state and an unsecured state, with the secured state being achieved when the upper wall is attached to the upper portion of the side wall of the exterior shell in a manner that prevents the upper wall from separating from the upper portion of the side wall of the exterior shell, and with the unsecured state being achieved when the upper wall is not prevented from separating from the upper portion of the side wall of the exterior shell; and the secured state of the upper wall is achieved by snapping the upper wall into the inner circumferential groove of the upper portion of the side wall of the exterior shell, and the unsecured state of the upper wall is achieved by removing the upper wall from the inner circumferential groove of the upper portion of the side wall of the exterior shell.

7. A fluid burning candle lamp comprising an exterior shell, aid exterior shell having a side wall and an interior enclosed compartment suitably configured to contain a liquid fuel;

an upper wall, said upper wall being adjacent to and in connection with an upper portion of the side wall of the exterior shell, with the upper portion of the side wall of the exterior shell having a plurality of female bayonet slots formed circumferentially about an interior surface, and the upper wall having a plurality of male bayonet pins extending from its perimeter, with the plurality of male bayonet pins configured to engage with the plurality of female bayonet slots;

a lower wall, said lower wall being adjacent to and in connection with a lower portion of the side wall of the exterior shell, with the side wall of the exterior shell, the upper wall of the exterior shell, and the lower wall of the exterior shell defining the interior compartment of the exterior shell;

a wick, said wick being an elongate cord-like member having an upper end and a lower end, with the lower end suitable for being placed into said liquid fuel, said wick capable of drawing said liquid fuel up from its lower end to its upper end, with said upper end suitable for maintaining a flame; and a wick aperture, said wick aperture formed into and through the upper wall and configured to accommodate the wick, such that the wick passes into and through said wick aperture and is held in place therein, with the upper end of the wick located above the upper wall and the lower end of the wick located below the upper wall within the interior compartment of the exterior shell;

wherein the upper wall is removably attached to the upper portion of the side wall of the exterior shell such that the upper wall can be repeatedly attached to and detached from the upper portion of the side wall of the exterior shell without the use of tools, independent fasteners, or adhesives and without damage to the upper wall or to the upper portion of the side wall of the exterior shell;

whereby the upper wall has a secured state and an unsecured state, with the secured state being achieved when the upper wall is attached to the upper portion of the side wall of the exterior shell in a manner that prevents the upper wall from separating from the upper portion of the side wall of the exterior shell, and with the unsecured state being achieved when the upper wall is not prevented from separating from the upper portion of the side wall of the exterior shell; and the secured state of the upper wall is achieved by engaging the male bayonet pins with the female bayonet slots, and the unsecured state of the upper wall is achieved by disengaging the male bayonet pins from the female bayonet slots.

* * * * *